United States Patent [19]

Lemelson

[11] Patent Number: 4,755,237

[45] Date of Patent: Jul. 5, 1988

[54] METHODS FOR MAKING CUTTING TOOLS

[76] Inventor: Jerome H. Lemelson, 48 Parkside Dr., Princeton, N.J. 08540

[21] Appl. No.: 906,882

[22] Filed: Sep. 15, 1986

Related U.S. Application Data

[63] Continuation-in-part of Ser. No. 674,933, Nov. 26, 1984, abandoned, and a continuation-in-part of Ser. No. 364,497, Apr. 1, 1982, abandoned, and a continuation-in-part of Ser. No. 167,672, Jul. 11, 1980, abandoned.

[51] Int. Cl.[4] ..... C21D 1/06; C21D 9/18

[52] U.S. Cl. ..... 148/152; 148/403; 148/903; 148/905; 219/121.69

[58] Field of Search ..... 148/403, 152, 4, 9.5, 148/9 R, 1, 900, 905, 901, 903, 902; 219/121 LJ, 121 EK, 121 LF, 121 EG

[56] References Cited

U.S. PATENT DOCUMENTS

| | | | |
|---|---|---|---|
| Re. 30,106 | 10/1979 | Polk et al. | 148/403 |
| 4,122,240 | 10/1978 | Banas et al. | 148/4 |
| 4,352,698 | 10/1982 | Hartley et al. | 148/900 |
| 4,473,735 | 9/1984 | Steffen | 219/121 LJ |

*Primary Examiner*—L. Dewayne Rutledge
*Assistant Examiner*—S. Kastler

[57] ABSTRACT

Improvements are provided in the structures of cutting tools and methods for producing such tools. The tool structures include providing a select portion or portions of a cutting tool, such as one or more portions adjacent a cutting or forming portion or edge or plurality of edges of a tool, of amorphous or non-crystalline metal or metal alloy having strength and wear characteristics which are superior to those of conventional metals and alloys which are crystalline in structure. Such amorphous metal may be formed in situ along the cutting edge portion of a cutting tool or blade by intense radiation beam scanning or may be formed of deposited or otherwise secured amorphous metal strip.

15 Claims, 1 Drawing Sheet

METHODS FOR MAKING CUTTING TOOLS

CROSS REFERENCE TO RELATED APPLICATIONS

This is a continuation-in-part of Ser. No. 674,933 filed 11/26/84 and a continuation-in-part of Ser. No. 364,497 filed 4/1/82 and a continuation-in-part of Ser. No. 167,672 filed 7/11/80, all now abandoned.

BACKGROUND OF THE INVENTION

1. Field of the Invention

The invention is in the field of cutting tool structures and methods for producing same of amorphous and crystalline metal.

2. Description of the Prior Art

The prior art teaches the production of amorphous metal and the use of strips of such metal for fabricating cutting tools or the coating of a crystalline metal with an amorphous metal film by sputtering or vapor deposition.

U.S. Pat. No. 3,871,836 discloses cutting blades formed entirely of amorphous metal or formed from a crystalline metal strip coated entirely with amorphous metal. A sandwich blade construction is also proposed wherein an amorphous metal strip is laminated between two strips of softer metal. The former structure is costly to produce and does not have the advantages of the characteristics exhibited by crystalline metal. Furthermore many types of cutting tools, such as drills and milling cutters, have shapes and cross section which are difficult to produce of amorphous metal. Film coating of tool and blade bases with amorphous metal is costly and provides non-crystalline coatings of limited life and applications.

U.S. Pat. No. 4,122,240 relates to the surface treatment of metal by heating the entire article to melt a surface layer thereof. Amorphous surface layers may be so produced.

British Patent No. 1,521,841 discloses the production of amorphous metal alloys for use in producing razor blades and the like.

SUMMARY OF THE INVENTION

This invention relates to improvements in cutting tools and in particular to cutting tools having one or more cutting edge portions which are formed of non-crystalline, fast-frozen metal or an alloy of metal. Such non-crystalline metal may be formed of a metal defining a blade or cutting tool per se or a metal or alloy which is deposited against or adjacent the cutting edge thereof and is utilized per se or is shaped after being so deposited, to define a cutting edge which is superior in structure to cutting edges made of conventional metal or alloys of metal.

It is known in the art to form thin ribbons or strips of metal or alloys in amorphous, non-crystalline, glassy metal state, which non-crystalline metal has physical characteristics which are improvements over the physical characteristics of conventional metals from which they are made. Such non-crystalline metal strips may be formed by injecting a liquid metal against a fast moving substrate such as a rotating metal disc or drum, in such a manner as to form a ribbon thereof by the rapid solidification of such metal as it rapidly transfers its heat to the fast moving substrate. Such non-crystalline metals and alloys exhibit superior physical characteristics when compared to such characteristics of the metal from which they are formed when it is conventionally formed to shape by such processes as molding, casting, extrusion or other means which result in the formation of crystalline structure thereof. The instant invention employs such non-crystalline metal which is either formed in situ of the metal of a cutting tool, a coating of metal supported by the tool or is bonded to the cutting tool and sharpened or otherwise shaped with a cutting edge thereafter. As a result, a superior cutting tool having one or more cutting edges which substantially outlast conventional cutting edges of the same metal or alloy, may be produced.

Accordingly it is a primary object of this invention to provide new and improved structures in cutting tools together with apparatus and method for producing same.

Another object is to provide an improved cutting tool formed at least in part of a non-crystalline metal or metal alloy defining at least a cutting edge thereof and at least a portion of one or more walls of the tool extending to such cutting edge.

Another object is to provide a cutting tool containing at least a portion of its blade or cutting edge formed of a non-crystalline metal from the metal disposed along and adjacent to the cutting edge.

Another object is to provide a cutting tool with a cutting edge defined by non-crystalline metal or metal alloy, which non-crystalline material is formed in situ along the cutting edge of the tool.

Another object is to provide a cutting tool having at least a portion of its cutting edge highly resistant to the erosive effects of cutting by having a glassy, non-crystalline structure.

Another object is to provide a cutting tool with a cutting edge which may be rapidly renovated or improved in structure by scanning same with an intense radiation beam.

Another object is to provide an improved method of forming a cutting tool.

Another object is to provide a method of improving the structures in cutting edges of cutting tools.

Another object is to provide an apparatus and method for forming select portions of blades, tools and the like with non-crystalline metal structures.

Another object is to provide an improved method of enhancing the life of a cutting tool a number of times during its operational use.

Another object is to provide an apparatus and method for forming cutting blades, such as razor blades and the like with non-crystalline portions thereof operable to improve the life of the blade material.

Another object is to provide an apparatus and method for forming selected portions of metal articles made of crystalline metal into non-crystalline structures.

Another object is to provide a method of forming selected portions of crystalline metal articles into non-crystalline metal structures by melting such selected portions and rapidly cooling same to a non-crystalline state by effecting supersonic relative motion between such articles and a surrounding gas or a gas stream directed thereagainst.

Another object is to provide new and improved composite materials and articles made of metal having one or more select portions thereof converted to non-crystalline form.

With the above and such other objects in view as may hereafter more fully appear, the invention consists of the novel constructions, combinations and arrangements of parts as will be more fully described and illustrated in the accompanying drawings, but it is to be understood that changes, variations and modifications may be resorted to which fall within the scope of the invention as claimed.

DESCRIPTION OF THE DRAWINGS

FIGS. 1 and 2 show a first form of the invention defined by a cutting tool 10, such as a cutting blade, knife, milling or lathe cutter or any device used to cut metal and other materials. The cutting edge portion 12 of the blade or tool base 11 is shown as having side walls 13 and 14 which taper towards each other to an edge 15, which edge is used to cut or shear work such as metal or other materials. The tool shape, taper and edge portion may be of any suitable configuration and, while the tool itself is preferably formed of steel, such as tool steel, it may be made of a suitable metal or metal alloy formed by such processes as rolling, casting, extrusion, sintering from powdered metal or other suitable process. The end or edge portion 12 of the tool base 11, may be made of a different metal or alloy than its support. The extreme portion 12A of end portion 12, near the edge 15 thereof contains portions of the side wall surfaces 13 and 14 which are converted to thin layers 13A and 14A of the metal forming the blade or cutting edge portion, which layers have been converted to amorphous, non-crystalline, glassy metal or metal alloy by heating the metal of such layers to a molten state and rapidly cooling same at the rate of hundreds of thousands or millions of degrees per second or more so as to prevent crystal formation of the melted metal.

Figure 1:
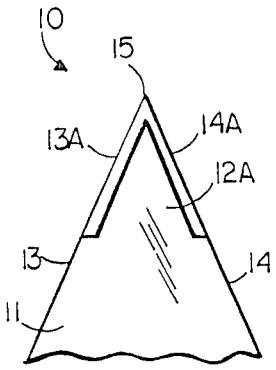
FIG. 1 is a partial end view of a magnified portion of a cutting tool or blade showing the cutting edge thereof with its structure out of scale for clarity.

One method for effecting such rapid melting and cooling is to scan the metal adjacent the edge 15 with one or more laser beams in a manner to effect such non-crystalline metal formations, such as when the blade or tool and the beam or beams employed to melt such edge portion, are in fast relative movement so as to permit the rapid cooling and solidification of the melted metal before it crystallizes. The tool or blade base 11, for example, may be made to travel at supersonic speed past one or more intense radiation beams, such as generated by lasers or electron guns, in a gas atmosphere such that suitable heat transfer is effected between the molten metal and the gas molecules, as well as to the metal substrate, to cause the molten metal to so rapidly cool as to form into a non-crystalline metal structure. Depending on the configuration of the substrate or base 11, the characteristics of the metal thereof, the temperature thereof during the melting of the metal adjacent the cutting edge of the tool and the characteristics of the atmosphere surrounding the tool during the melting of the select portion or portions of the substrate, such non-crystalline structure may be formed of all or a portion of the molten metal and may therefor provide at least a small portion of the cutting tool, particularly that adjacent to and defining the cutting edge or tip 15, in a non-crystalline state and exhibiting superior wear resistant characteristics with respect to the crystalline metal of which it is formed. A portion of the metal defining the substrate or base 11 which is so converted to non-crystalline metal may be merely that which is immediately adjacent the cutting edge or may extend for some distance along the side walls 13 and 14 which taper towards each other, as shown, depending on what structure in the cutting tool is desired which, in turn, is dependent upon the intended use of the cutting tool and the material or materials which it is intended to cut or otherwise shape. While the portions 13A and 14A of the end portion 12 are shown as extending for some distance along the side walls 13 and 14 from the cutting edge 15, such former portions which are converted to non-crystalline metal may merely be defined along the apex of the surfaces 13 and 14 for several thousandths of an inch or less therefrom.

In the construction illustrated in FIG. 1, one or more separate electron or laser beams may be employed to melt the metal or alloy forming the substrate portion 12 and to form a non-crystalline metal or alloy thereof either by effecting high speed relative movement of the cutting tool or blade 11 in a dense gas atmosphere to permit the molecules of gas to rapidly receive and transfer heat from the molten metal and thereby rapidly cool same to a non-crystalline structure. Such relative movement may be effected by rapidly moving the cutting tool 11 through such gas atmosphere or, conversely, forming a supersonic stream of gas molecules and directing same against the molten metal immediately after the high intensity laser or electron beam or beams melt the portions of the substrate adjacent the end 12A of the end portion 12 and the cutting edge 15.

Figure 2:
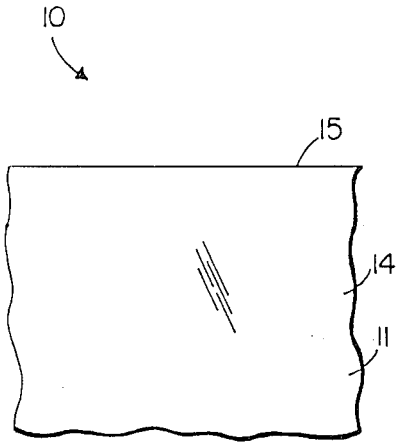
FIG. 2 is a side view of a fragment of the cutting tool portion shown in FIG. 1.
Figure 3:
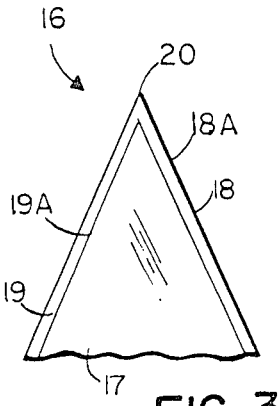
FIG. 3 is an end view of a portion of a cutting tool having a structure which is a modified form of that shown in FIG. 1.

In FIG. 3 is shown a modified form of the invention illustrated in FIGS. 1 and 2 and defining an improved structure in a cutting tool 16, such as the described knife blade, razor blade, or machine cutting tool, having an end portion 17 with tapered side wall portions 18 and 19 extending to a cutting edge 20. Disposed along the side wall portions 18 and 19, is a plating defined by layers 18A and 19A of a suitable metal or alloy which is either provided in a non-crystalline condition when it is bonded or plated onto the walls 18 and 19 or which is formed in such non-crystalline state immediately adjacent the cutting edge, after being so plated onto the substrate 17.

Laser or electron beam scanning techniques and apparatus of the types illustrated and described in copending application Ser. No. 167,672 and modified forms thereof may be employed in the fabrication and modification of the cutting edges of the tools described herein. For example, the beam generating devices of said parent application may be utilized to both form cutting edges, as described, of tool steel or other material and to modify same and described herein by providing a surface layer and edge portions of the tool formed of non-crystalline, amorphous metal structureby properly controlling the intensity and direction of the electron or laser beam or beams during scanning.

Figure 4:
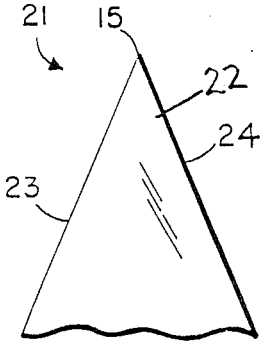
FIG. 4 is an end view of a portion of a cutting tool including the cutting edge thereof, which tool is made of a laminate of non-crystalline metal.

In FIG. 4, the end portion 22 of a cutting tool 21 has side walls 23 and 24 which taper towards each other and which may be formed by grinding or otherwise machining same to a suitable shape defining an edge 25. The material of which the end portion 22 of tool 21 is formed is preferably a laminate of a ribbon or sheets defining a fast-frozen metal having superior strength and corrosion resistant characteristics to that of the metal from which the elements of the laminate is formed. Once the laminate is formed and bonded together, such as by means of a suitable adhesive, the cutting tool is formed by means of grinding or other means, to the shape shown in FIG. 4.

Figure 5:
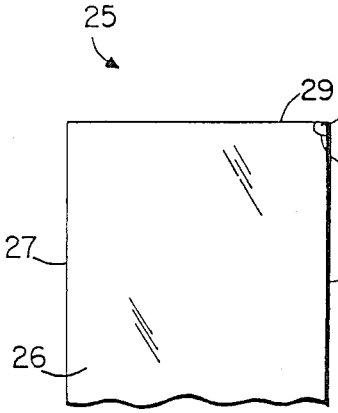
FIG. 5 is a side view of a portion of a cutting tool used to machine metal and the like and having a cutting edge portion thereof which is constructed of non-crystalline metal or alloy.

In FIG. 5 is shown a cutting tool 25 for a lathe, milling machine, or other form of machine which employs such tools either per se or supported by a common base or structure permitting the tool to be brought into and out of operative relation with work. The tool 25 contains an end portion 26 having side walls 27 and 28 and an end wall 29. The juncture of the end walls 28 and 29 defines a cutting edge 30, the material of which cutting edge and that immediately adjacent thereto, has been converted to a non-crystalline metal or alloy structure improving its resistance to wear and attrition when compared with the metal forming the end portion 26 itself. The converted portion 31 of the cutting edge 30 may be formed in situ on the substrate 26 by scanning same with a suitable source of high intensity beam energy, such as a laser generated beam, electron beam or other high energy beam capable of melting and permitting the rapid solidification of the material defining and adjacent the cutting edge 30.

Figure 6:
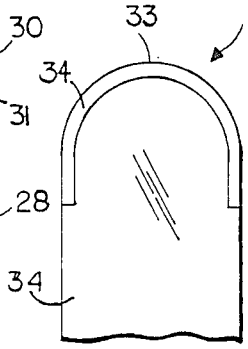
FIG. 6 is a side view of a modified form of cutting tool having a rounded cutting edge which is modified in structure.
Figure 7:
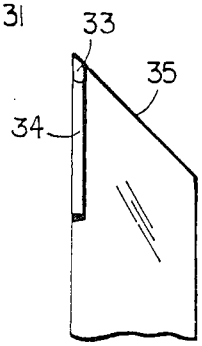

In FIGS. 6 and 7, the end portion 32 of a cutting tool 31 is shown as having a rounded cutting edge 33 which is defined by a flat face wall 34 and a tapered end wall 35 as illustrated in FIG. 7. The arcuate edge 33 of the tool may be utilized, for example, as part of a lathe cutter, milling or shaping cutter. The material 34 defining the arcuate edge 33 may also be formed by depositing metal around the cutting edge of the tool, preferably as a thin film or layer thereof and thereafter grinding or otherwise shaping, if necessary, to provide a cutting edge which is enhanced in its physical characteristics by scanning same with such laser or electron beam in a manner to rapidly melt such material adjacent the cutting edge whereafter it rapidly cools to define such non-frozen metal.

The shape, taper and edge portions of the tools described may be any suitable configuration or configurations and, while the tool itself is preferably formed of steel, such as tool steel. It may be made of a suitable metal or metal alloy. The end or edge portion of the tool may be made of a different metal or alloy than its support or base while the extreme portion of metal, such as 12A of FIG. 1, adjacent the cutting edge, may be of the same metal or a different metal or alloy than that forming the remaining portion of the tool.

The following is a summary of the techniques which may be employed to form non-crystalline metal portions of articles, such as cutting edge portions and/or portions designed to resist wear and corrosion during use.

1. One or more intense radiation beams are caused to scan a select portion or portions of an article such as a blade, tool or way and to melt a portion of the surface layer of the tool whereafter the heat of the melted metal is rapidly dissipated to the remaining metal of the tool causing the melted material to form a non-crystalline structure in situ on the remaining metal of the article.

2. The article may be driven at supersonic speed past the intense radiation beam or beams directed at one or more selected portions of the article wherein the melted portion(s) rapidly cool when the heat thereof is transferred to the gas molecules, so as to form non-crystalline metal thereof.

3. A gas or liquid jet or jet streams may be directed at a portion or portions of the tool or article along or adjacent the portion(s) thereof which are rapidly melted by means of the intense radiation applied thereto so as to rapidly cool and solidify same to non-crystalline structure.

4. Two or more of the cooling and solidifying techniques described above may be combined to rapidly solidify and form the melted portion or a portion thereof into non-crystalline metal structure in situ on the article or tool.

5. The article or tool may be chilled or reduced sufficiently in temperature before applying the intense radiation to melt the select portion or portions thereof so as to rapidly dissipate the heat of the metal and form non-crystalline metal thereof. Such chilling may be performed by passing the tool or a portion thereof through a liquified gas such as liquid nitrogen, hydrogen, etc., just prior to melting the edge or other portions(s) thereof.

6. After the non-crystalline edge portion or portions of the cutting tool described above are formed, a tool sharpening operation or a number of operations maye be performed to suitably sharpen the cutting edge or edges of the tool. While the sharpening operation may be effected by light grinding at a temperature insufficient to melt or destroy the non-crystalline structure so formed, it may also be effected by grinding with a coolant which operated to prevent such heating and structure destruction and may comprise or include honing to sharpen the edge portion or portions of the tool.

7. Modification of the operations described herein may be utilized to form selected portions of the surface strata of cutting tools and other tools or mechanical devices to non-crystalline form wherein the portions thereof which are converted to non-crystalline surface layers of the substrate or coating on the tools or devices are subject to corrosion, frictional wear and mechanical attrition and wherein the treatment and non-crystalline metal structures resulting from such treatment provide one or more surface portions which better resist wear and corrosion during use and wherein the surfaces structure so formed is void of surface irregularities and cracks which would cause failure of the component at an earlier in its use.

8. The techniques described herein for converting a portion or portions of a cutting tool, blade or other device may be used to improve or recondition worn cutting tools to provide same with improved cutting edges and in certain instances to sharpen same. Also, surface refinishing to improve resistence to erosion and corrosion may be so effected by melting and rapidly cooling select portions of a tool or device such as a shaft, bearing surface, ball or roller bearing surface, slide, way, key or other device subject to frictional wear.

9. A weld and/or material adjacent a weld may be improved in structure and strength by scaning same with an intense laser or electron beam to melt a select portion of the surface stratum thereof which is rapidly cooled to form such surface stratum into the described non-crystalline metal structure. The same or an auxiliary beam generating device used to effect the weld may be employed to scan the weld and/or material adjacent thereto to form such non-crystalline metal structure.

10. To rapidly solidify the surface stratum of metal of a metal article or a coating on an article after it has been rendered molten by an intense laser or electron beam, one or more jets of liquid and/or gas may be directed parallel to the surface and/or at an angle thereto so as to cause molecules of the rapidly flowing fluid to contact and receive heat from the surface stratum rendered molten and to rapidly transfer such heat in a manner to cause the molten metal to form either a non-crystalline structure or a structure which is substantially amorphous and of higher strength than the crystalline metal.

Modifications of the tool structures described above and illustrated in the drawings are noted as follows:

1. The tools and portions thereof which are illustrated in FIGS. 1–7 may be subject to substantial variations in shape and may be defined by, for example, such complex cutting tools as milling cutters, lathe cutting tools, knives, scissors, and other forms of household and industrial cutting tools.

2. The non-crystalline metal portion or portions of the cutting tool may extend completely around the cutting edge thereof or one or more selected portions of the cutting edge which selected portions are located and operable to be subject to substantial, if not, all of, the attrition to which the cutting tool is subjected during its operation. In other words, one or more portions of the metal or alloy defining the cutting tool and located immediately adjacent the cutting edge, may be space-separated from each other and shaped to bear the brunt of most if not all of the attrition effected during cutting operations. For example, the cutting tool structures illustrated in FIGS. 1–7, may be modified to define same as the teeth of a circular or blade saw, the flutes or cutting edges of a drill, milling cutter or other form of cutting tool, simple or complex portions of other shapes and types of cutting tools and the like.

3. It is noted that the same beam or beams employed to reform the non-crystalline metal alloy adjacent the cutting edge of the cutting tool, may also be employed to form such cutting edge in a single operation, by intense radiation erosion of the material of the cutting tool adjacent the edge thereof and intense radiation adapted to melt and permit the rapid solidification of at least a portion of the remaining metal or alloy adjacent the cutting edge.

4. Structures of the types described above and illustrated in the drawings or modifications thereof employing amorphous or con-crystalline metals may be employed to enhance the abrading and cutting action and longivity of a variety of abrading and cutting devices and materials other than cutting blades and tools of the types described. For example, abrasive natural or synthetic abrasive bits of the types used in the construction of cutting and grinding tools and wheels may be totally or partly coated with amorphous metal, layers of different amorphous metals or alloys of amorphous metal by one or more of the processes of vapor deposition, sputtering, plating or electrodeposition, electroless deposition, sintering, electron or laser beam deposition to provide such bits or particles with hard, wear-resistant surface coatings which protect the hard particles from surface attrition during cutting or abrading therewith. Such abrasive particles as diamond, cubic-boron-nitride and refractory metal bits formed of a variety of metal carbides, nitrides, borides, oxides and silicides as well as others within the range of 8–10 on the MOH hardness scale, may be coated with non-crystalline metals such as nickle, chromium, titanium, tungsten, etc. and alloys of such metals such as described in U.S. Pat. Nos. 4,122,240 and 3,871,836 and U.K. Patent No. 1,521,841. Such coatings may be applied while the particles are in free fall through space, suspended in a solution or in motion therein as in electrodeposition or electroless deposition, disposed against a surface or bonded to a substrate such as the surface of a tool, bit or grinding wheel.

5. The structures described above may comprise a plurality or multitude of coatings, films or otherwise deposited layers of the same or one or more different amorphous or non-crystalline metals as described or alloys of metals deposited one on top of the other against the entire tool or bit or a selected portion or portions thereof or a combination of one or more metal and/or alloy coatings deposited one on top of the other to impart desired physical characteristics to the tool or bit on which they are coated or laminated.

6. The structures described above involving the partial coating of a cutting tool, such as a rotary cutting tool, saw blade or grinding wheel with amorphous metal or metal alloy may be effected while the tool or cutting device is in a machine or a tool holder held by an automatic tool changer after the tool edge or coating thereon has become worn due to use to renovate or repair the worn coating.

7. The structure described above in coatings, assemblies and laminations may employ one or more layers or coatings of metal or metal alloys which have been only partly converted to amorphous metal or alloys of metal which retaining a predetermined degree of crystalline structure depending on the physical characteristics desired of the coating or edge portion. The hard metal or alloy layer may also vary in non-crystalline structure with thickness from a startum exhibiting more crystallinity near the base of the layer to one of less crystallinity or nearly all amorphous structure at the surface stratum thereof.

8. A combination of sputtering and beam heating may be employed to provide the hard metal or alloy layers described of non-crystalline structure wherein a beam of electrons and/or laser light is applied to the substrate during and/or in between sputter deposition of metal or metal alloy to the substrate to serve one or more functions such as forming a layer or layers of amorphous or fine grain metal or alloy and to bond the sputtered metal or alloy to the surface receiving same. Such beam scanning may also be used to rapidly melt or bond metal or alloy material deposited on the surface by other means for forming an amorphous or fine grained coating thereon.

9. In the previously described embodmient of the invention in which a cutting tool, such as a drill or milling cutter, tool bit or other type of cutting tool is supported by the machine which operates to cut material, such as metal, therewith, and is sharpened and/or rendered non-crystalline along a cutting edge or edges thereof, such opeation may be effected in an automatic manner by machinery including a laser or electron gun supported on the tool or supported by an automatic manipulator servicing two or more machine tools by moving between such tools and or directing radiation in the form of a beam or beams along different paths to the cutting tools requiring such sharpening and/or deposition or non-crystalline. Scanning to sharpen and render material adjacent the cutting edges of such tools may be effected by computer controlling one or more motors operable to drive the laser and/or reflecting mirror(s) for its beam in a controlled manner as the operation is required. Requirement for effecting such operation or operations may be determined by one or more sensors sensing tool operation and/or cutting edge condition or sharpness and providing feedback signals which are computer processed and analyzed to effect the generation of command control signals for controlling the movement of the laser or electron gun along a fixed path and the proper deflection control of the beam thereof to scan the necessary cutting edge or edges of the tool as described for performing the operation or operations described herein. Such variables as cutting tool vibration, resistence to cutting; visual, X-ray or ultrasonic image of the tool and its cutting edge as sensed by suitable electrooptical or other form of sensor(s), may be employed to generate such feedback signal(s).

10. In addition to operating of the cutting tool as described, while the tool is held in a tool holder on the cutting machine using the tool, the tool may also be sharpened while it is supported at a working location on an automatic tool holder or tool holding fixture from which the tool is carried to the machine operating head.

11. In another embodiment of the invention, the apparatus described may be employed to effect the implantation of ions into the tool material along the cutting edge and adjacent thereto, such as the described portion or portions rendered non-crystalline or a coating applied to the tool along the cutting edge, prior to during or immediately after the operation of sharpening and rendering the cutting edge material non-crystalline or amorphous. Such ion implantation and the other operations described may all be under the control of a single computer which controlls beam operation, beam intensity, beam deflection and/or tool movement therepast and laser manipulation as described to effect the implantation and beam scanning. Such implantation may be effected using the energy of the same laser or electron gun used to render the select portion of the tool molten.

What is claimed is:

1. A method of forming a cutting tool comprising:

(a) forming a cutting tool base having a metal portion thereof which is operable to be formed with a cutting edge, (b) scanning said portion of said tool base with an intense radiation beam in a manner to remove material from said base and to form a cutting edge along the portion of said base from which said material is removed, (c) transferring a portion of the heat of said radiation beam to the material of said cutting tool to melt a select portion of said material adjacent said cutting edge of said tool, and (d) rapidly cooling at least a portion of the melted material in a manner to form a layer of non-crystalline metal of high wear resistence adjacent said cutting edge.

2. A method in accordance with claim 1 wherein said scanning step is effected by means of an intense light beam generated by a laser.

3. A method in accordance with claim 1 wherein said scanning step is effected by means of an intense electron beam generated by an electron gun.

4. A method in accordance with claim 1 including implantating ions with said radiation beam in a select portion of the material of said cutting tool to improve the wear resistance of the cutting tool.

5. A method in accordance with claim 1 wherein the noncrystalline metal formed on said cutting tool base is formed so as to define the cutting edge of said tool.

6. A method in accordance with claim 1 including depositing a hard surfacing material on said cutting tool base to form said metal portion to be formed thereafter with said cutting edge.

7. A method in accordance with claim 1 including depositing a plurality of layers of metal, one above the other on said base and forming the cutting edge portion of said tool of said plurality of layers.

8. A method in accordance with claim 7 wherein each of said layers of metal deposited one above the other on said base is formed in and retains a non-crystalline structure.

9. A method in accordance with claim 1 wherein steps (b) to (d) are performed while said tool base is supported by a machine in a tool holder.

10. A method in accordance with claim 1 wherein steps (b) to (d) are performed while said tool base is supported by a tool holder supported by a machien operable to use said cutting tool in cutting work.

11. A method in accordance with claim 10 wherein said tool base contains a cutting edge portion requiring sharpening, step (b) to (b) being operable to sharpen said cutting edge while said tool base is supported in a tool holder which is operatively supported by said machine for use in cutting material.

12. A method in accordance with claim 10 wherein steps (b) to (d) are performed while said cutting tool is operating.

13. A method in accordance with claim 1 wherein said cutting tool is supported by a machine and step (b) to (d) are performed while the machine is not operating.

14. A method in accordance with claim 1 wherein said tool is a composite structure formed of a substrate with a coating of metal secured to at least a portion of said substrate, which metal coating is crystalline in structure, said method including converting at least a portion of the metal coating said substrate to said amorphous metal by rendering at least a portion thereof molten and rapidly cooling the molten metal.

15. A method in accordance with claim 14 wherein said heating is effected by scanning a select portion of the surface of said article with a high intensity radiation beam and the rapid cooling of the molten portion of said metal is effected by directing a stream of cooling fluid against that portion of the surface said article immediately rendered molten by said radiation beam to rapidly cool and solidify the metal shortly after it is rendered molten by said beam.

* * * * *